US009205642B2

(12) United States Patent
Schaffrath et al.

(10) Patent No.: US 9,205,642 B2
(45) Date of Patent: Dec. 8, 2015

(54) METHOD FOR CLEANING AN ANILOX PRINTING UNIT

(71) Applicant: HEIDELBERGER DRUCKMASCHINEN AG, Heidelberg (DE)

(72) Inventors: Dieter Schaffrath, Lorsch (DE); Andreas Braun, Dudenhofen (DE); Steffen Hilbert, Obrigheim/Asbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/222,820

(22) Filed: Mar. 24, 2014

(65) Prior Publication Data

US 2014/0283705 A1 Sep. 25, 2014

(30) Foreign Application Priority Data

Mar. 22, 2013 (DE) ..... 10 2013 005 020

(51) Int. Cl.

*B41F 35/04* (2006.01)
*B41F 35/00* (2006.01)
*B41F 31/30* (2006.01)

(52) U.S. Cl.

CPC ..... *B41F 35/04* (2013.01); *B41F 35/008* (2013.01); *B41F 31/302* (2013.01); *B41P 2231/20* (2013.01)

(58) Field of Classification Search

CPC ..... B41F 35/04; B41F 35/008; B41F 31/30; B41F 31/301; B41F 31/302; B41F 33/10; B41F 7/10; B41P 2231/20; B41P 2233/11

See application file for complete search history.

(56) References Cited

U.S. PATENT DOCUMENTS

| | | | | |
|---|---|---|---|---|
| 7,373,882 | B2 | 5/2008 | Heuschkel et al. | |
| 7,677,174 | B2 * | 3/2010 | Eckel et al. | 101/483 |
| 2008/0134916 | A1 | 6/2008 | Luckhardt et al. | |
| 2013/0008327 | A1 * | 1/2013 | Diews | 101/123 |

FOREIGN PATENT DOCUMENTS

| | | | |
|---|---|---|---|
| DE | 102005056812 | A1 | 6/2006 |
| DE | 102007011043 | A1 | 10/2007 |
| DE | 102007053489 | A1 | 6/2008 |

OTHER PUBLICATIONS

DE102007011043 machine translation, Author—The Internet, Title Date Jan. 11, 2015, Publisher—The Internet, Edition—First, Pertinent Pages—all.*

* cited by examiner

*Primary Examiner* — Jill Culler
*Assistant Examiner* — Leo T Hinze
(74) *Attorney, Agent, or Firm* — Laurence Greenberg; Werner Stemer; Ralph Locher

(57) ABSTRACT

A method for cleaning an anilox printing unit includes a first process step and a second process step immediately following the first process step without any intermediate printing operation. In the first process step, printing ink is supplied to a screen roller from a blade-type ink fountain while an ink applicator roller is in contact with the screen roller and out of contact with a bridge roller of a dampening unit. In the second process step, printing ink is removed from the screen roller and returned into the same blade-type ink fountain while the ink applicator roller is engaged with the screen roller and with the bridge roller.

5 Claims, 2 Drawing Sheets

METHOD FOR CLEANING AN ANILOX PRINTING UNIT

CROSS-REFERENCE TO RELATED APPLICATION

This application claims the priority, under 35 U.S.C. §119, of German Patent Application DE 10 2013 005 020.0, filed Mar. 22, 2013; the prior application is herewith incorporated by reference in its entirety.

BACKGROUND OF THE INVENTION

Field of the Invention

The present invention relates to a method for cleaning an anilox printing unit.

When an anilox printing unit is to be prepared for the next job after a print job has been completed, it needs to be cleaned.

German Patent Application DE 10 2007 011 043 A1 describes a method for cleaning an anilox printing unit that includes a doctor blade, a screen roller, an ink applicator roller, a forme cylinder and a blanket cylinder. The doctor blade is part of a blade-type ink fountain including a pivotable rear wall that is pivoted away from the doctor blade to lower an ink level in the blade-type ink fountain below an edge of the doctor blade. In the prior art method, there is a period of time in which the doctor blade is engaged with the screen roller and the ink applicator roller is engaged with the screen roller but not with the forme cylinder and in which the screen roller and the ink applicator roller are cleaned without using a cleaning agent. In that process, the ink that is present on the screen roller and on the ink applicator roller from the previous print job is scraped back into the blade-type ink fountain by the doctor blade.

A problem in anilox printing units is that an ink profile corresponding to the printed image forms on the ink applicator roller and on the screen roller during a printing process. That corresponding ink profile results from the format-size diameters of the rollers and from the fact that as a consequence, the forme cylinder, the ink applicator roller, and the screen rollers roll congruently on each other. Likewise, an ink profile corresponding to the zonal ink requirements of the printed image forms on the smaller rollers of the inking unit and of the dampening unit. In a following print job, that ink profile is superposed on the new printed image. That ghosting effect results in an increased amount of spoiled prints during start-up. If the next print job has lower area coverage, an excess supply of ink may increase the amount of start-up waste by over inking. Thus, the ink needs to be removed from the inking unit for each job change.

In the aforementioned prior art (German Patent Application DE 10 2007 011 043 A1), the ink is removed from the inking unit by scraping the ink back into the ink fountain. A disadvantage thereof is that although the ink profile in the depressions of the screen roller is reduced, it persists in the form of different fill levels of the depressions of the screen roller. If the next print job involves a sensitive printing forme, that may lead to follow-up ghosting when the next job is started. Such a behavior is due to the fact that in anilox printing units, the amplitudes of the axial oscillation of the distributor rollers in the inking units are comparatively small, accordingly resulting in only minimum lateral or axial displacement of the ink. During the print run, that is an advantage as it reduces the tendency to ghosting, but when the ink is to be removed from the inking unit back into the ink fountain in the aforementioned process of scraping the ink back into the ink fountain, it is a disadvantage.

SUMMARY OF THE INVENTION

It is accordingly an object of the invention to provide a method for cleaning an anilox printing unit, which overcomes the hereinafore-mentioned disadvantages of the heretofore-known methods of this general type and in which any subsequent ghosting is avoided or at least substantially reduced.

With the foregoing and other objects in view there is provided, in accordance with the invention, a method for cleaning an anilox printing unit, which comprises carrying out a first process step and a second process step. In the first process step, ink is fed from a blade-type ink fountain to a screen roller while an ink applicator roller is in contact with the screen roller and out of contact with a bridge roller of a dampening unit. In the second process step, which follows without any intermediate printing operation, the ink is removed from the screen roller and returned into the same ink fountain while the ink applicator roller is in contact with the screen roller and with the bridge roller.

Advantages of the method of the invention are that the first method step leads to over inking, causing the inking unit of the anilox printing unit to be brought to a homogeneous starting condition, and that all inking unit rollers may be involved as ink storage elements. In the second step, the homogeneous starting condition is scraped off rather than different fill levels of depressions in the screen roller. In this way, any subsequent ghosting may largely be avoided.

Other features which are considered as characteristic for the invention are set forth in the appended claims.

Although the invention is illustrated and described herein as embodied in a method for cleaning an anilox printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
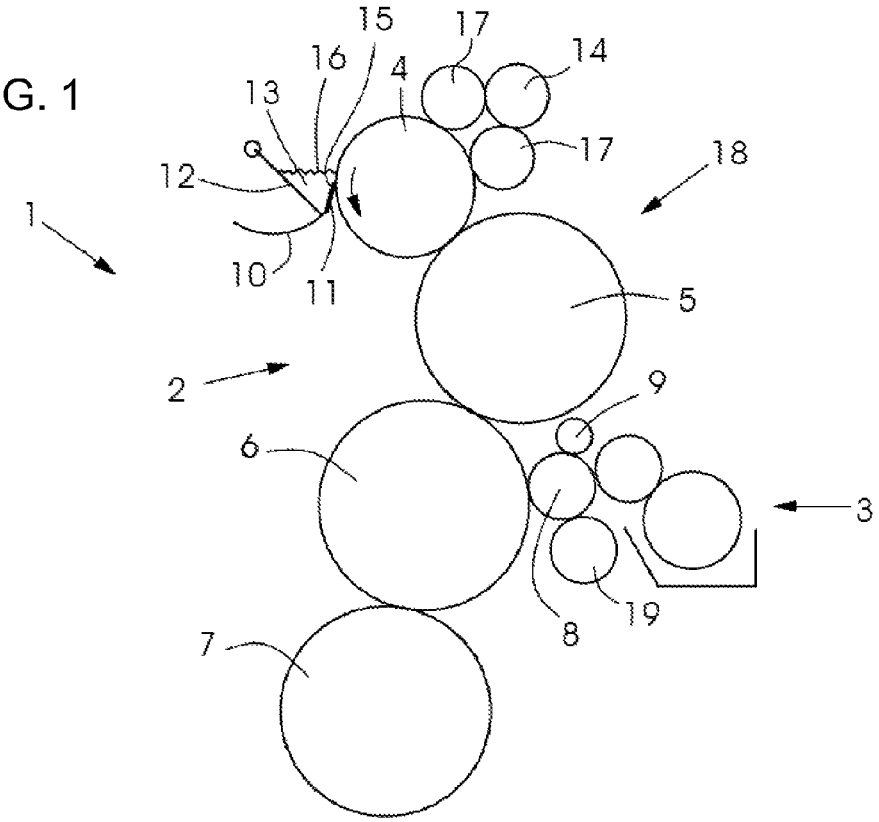
FIG. 1 is a diagrammatic, vertical-sectional view of an anilox printing unit during a printing operation.
Figure 2:
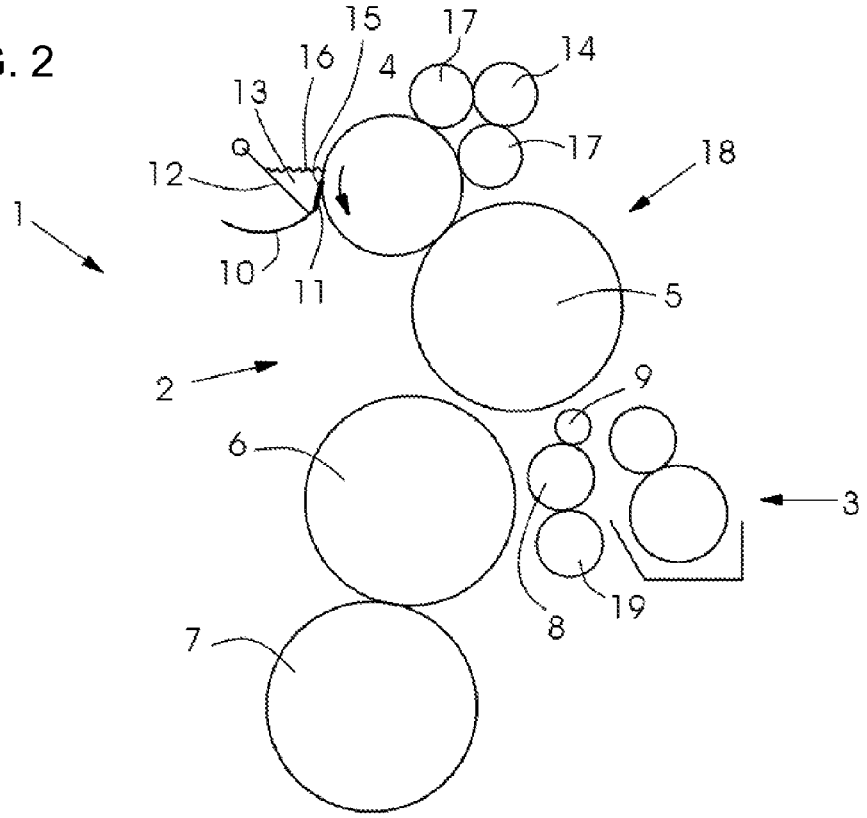
FIG. 2 is a vertical-sectional view of the anilox inking unit of FIG. 1 during a first process step (over inking) to reduce an ink profile in an inking unit.
Figure 3:
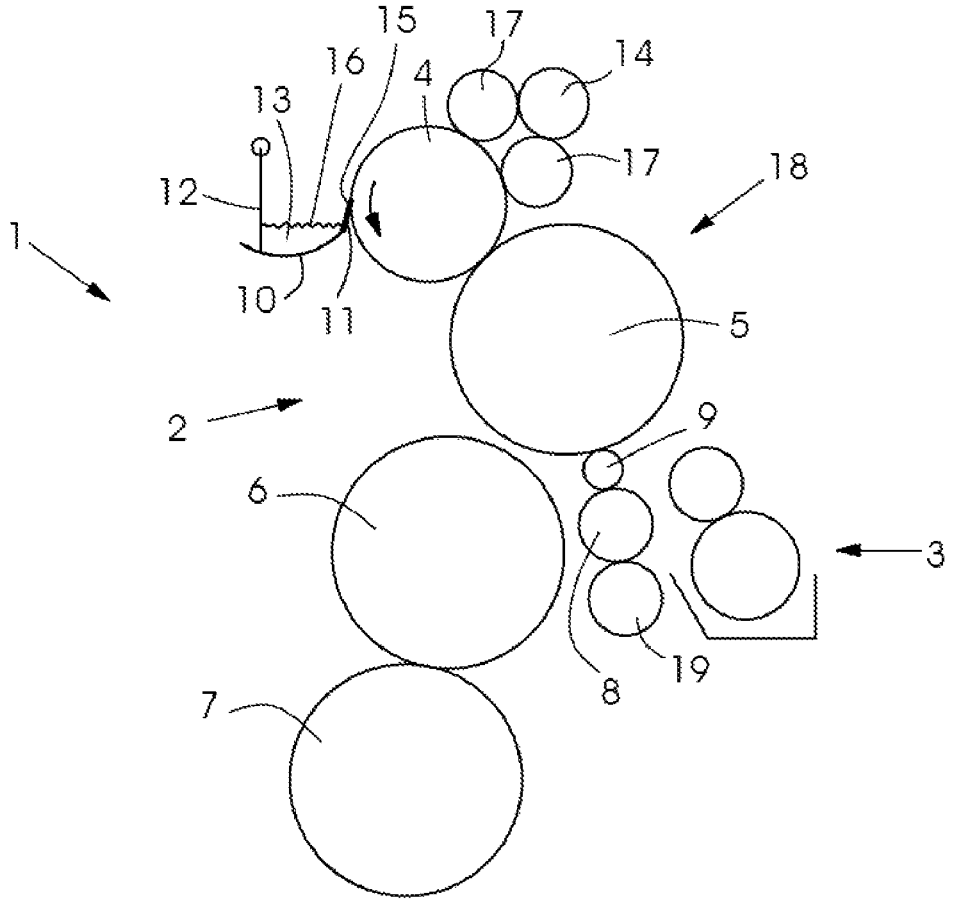
FIG. 3 is a vertical-sectional view of the inking unit of FIGS. 1 and 2 during a second method step (ink removal) to reduce the ink profile in the inking unit.

Referring now in detail to FIGS. 1 to 3 of the drawings as a whole, there is seen a printing press 1 including an anilox printing unit 18. The printing press 1 is a sheet-fed printing press, and the anilox printing unit 18 is a lithographic offset printing unit. The anilox printing unit 18 includes an anilox inking unit 2, a dampening unit 3, a forme cylinder 6 and a blanket cylinder 7.

The anilox inking unit 2 includes a screen roller 4, an ink applicator roller 5, two inking unit rollers 17 and a blade-type ink fountain 10 including a doctor blade 11 and a pivotable rear wall 12. Printing ink 13 defining an ink level 16 is provided in the blade-type ink fountain 10. When the pivotable rear wall 12 is pivoted towards the doctor blade 11 for a printing operation, the ink level 16 is above an edge 15 of the doctor blade as shown in FIG. 1. When the pivotable rear wall 12 is pivoted away from the doctor blade 11 during a cleaning operation in the anilox printing unit 18, the ink level 16 is located below the edge 15 as shown in FIG. 3. The pivotable rear wall acts as a displacer for selectively elevating and lowering the ink level 16. The anilox inking unit 2 further includes an axially oscillatable distributor roller 14 that is engaged with the two inking unit rollers 17, which are in turn engaged with the screen roller 4. The distributor roller oscillates at a comparatively small amplitude of 4 mm in each direction of oscillation.

Among other elements, the dampening unit 3 includes a dampening solution applicator roller 8, a bridge roller 9 and a dampening solution distributor roller 19. The dampening solution distributor roller 19 oscillates in an axial direction at an amplitude of 6 mm in each direction of oscillation and the bridge roller 9 oscillates in an axial direction at an amplitude of 3 mm in each direction of oscillation. Thus, the amplitudes of all of the axially oscillating rollers, i.e. of the distributor roller 14 of the anilox inking unit 2 as well as of the bridge roller 9 and of the dampening solution distributor roller 19 of the dampening unit 3, are smaller than 10 mm.

FIG. 1 illustrates a printing operation: the ink applicator roller 5 and the dampening solution applicator roller 8 are engaged with the forme cylinder 6. The ink level 16 in the blade-type ink fountain 10 is elevated. The bridge roller 9 is engaged with the dampening solution applicator roller 8 but is disengaged from the ink applicator roller 5. During a printing operation, the printing ink 13 is applied to the screen roller 4 by using the blade-type ink fountain 10.

In order to prepare the anilox printing unit 18 for the next print job once a print job has been completed, the printing unit 18 needs to be cleaned. This intermediate cleaning process reduces the ink profile of the completed print job in the inking unit. The process steps required for this purpose will be described below.

The first step is to disengage the dampening solution applicator roller 8 and the ink applicator roller 5 from the forme cylinder 6. This may be done in synchronism or successively. The bridge roller 9 remains disengaged from the ink applicator roller 5.

In a first step, an "over inking" step illustrated in FIG. 2, all of the inking unit rollers are engaged to roll on each other and the blade-type ink fountain is engaged with the screen roller 4. The pivotable rear wall 12 of the blade-type ink fountain 4 pivots towards the screen roller 4 to elevate the ink level 16. Ink is introduced into the anilox inking unit 2 from the blade-type ink fountain 10, for example during six revolutions of the ink forme cylinder 6, to even out the ink profile present in the inking unit 2 by covering it with the introduced ink. Although the actual aim is to reduce the thickness of the ink layer in the inking unit, the fact that the two inking unit rollers 17 and the distributor rollers 14 are involved in the over inking process are not contradictory. Due to the storage effect of the rollers 14, 17 the ink remains in the inking unit for a longer time and may be spread to the sides for a longer time and in a better way due to the lateral distribution. This accelerates the desired removal of the profile.

In a second process step, which is shown in FIG. 3, the ink level 16 is lowered below the edge 15, causing the blade-type ink fountain 10 to be capable of taking printing ink off the rotating screen roller 4. The lowering of the ink level 16 is achieved by pivoting the pivotable rear wall 12 away from the doctor blade 11. Preferably simultaneously with the lowering of the ink level 16, the bridge roller 9 is engaged with the ink applicator roller 5, causing rollers 19, 8, 9, 5, 4 to form a roller train. A dipping roller and a metering roller (both without reference numerals) of the dampening unit 3 are not included in the roller train and are thus not part of the process of removing the ink. The inking unit rollers 17, which have a rubbery-elastic deformation surface and are engaged with the screen roller 4, assist in cleaning the screen roller 4. As the rollers roll on each other, the circumferential surfaces of the inking unit rollers 17 are pressed into the screen depressions, i.e. cells or creases (trihelical engravings), of the screen roller 4 for a short time and the circumferential surfaces suck residual ink out of the screen depressions as they exit the screen depressions. As contact is maintained between the screen roller 4 and the ink applicator roller 5 during the cleaning process, the printing ink that is still on the ink applicator roller 5 is taken off the latter by the screen roller 4 and is scraped off the latter by the doctor blade 11. In the same way, the dampening solution applicator roller and the bridge roller 9 are also cleaned in the process. The residual ink from the latter two rollers is conveyed into the blade-type ink fountain 10 by the ink applicator roller 5 and the screen roller 4. In order to clean the ink applicator roller 5 and the screen roller 4, which is done in the second process step (FIG. 3) exclusively by the doctor blade 11, no cleaning agent of any kind is used. Thus, the supply of printing ink 13 in the blade-type ink fountain 10 is not in danger of being contaminated by cleaning agents.

In the second process step, which is shown in FIG. 3, the doctor blade 11 is engaged with the screen roller 4 and simultaneously the ink applicator roller 5 is engaged with the screen roller 4, but not with the forme cylinder 6. The bridge roller 9 is engaged with the ink applicator roller 5 and simultaneously with the dampening solution applicator roller 8, which is in turn engaged with the dampening solution distributor roller 19. Ink from the anilox inking unit 2 enters into the dampening unit 3 through the bridge roller 9. Yet this ink only reaches the dampening solution applicator roller 8 and the dampening solution distributor roller 19, but not the metering roller, which is disengaged from the ink applicator roller 8, nor the dipping roller, which is engaged with the metering roller and is part of the dampening unit 3. The emulsion profile present in the dampening unit 3 is overlaid by ink that enters into the dampening unit 3. Due to the lateral distribution in the dampening unit 3 caused by the bridge roller 9 and the dampening solution distributor roller 19, the ink that has gotten into the dampening unit is likewise spread to the sides and is split back onto the ink applicator roller 5 in the spread condition. The second process step of removing the ink is shown in FIG. 3 and is carried out during approximately 100 to 150 revolutions of the forme cylinder 6 (machine revolutions). Since this ink removal deteriorates as the machine speed increases, an upper speed limit of 9000 revolutions, for example, is defined for the ink removal step in an electronic control unit of the printing press that controls the process.

In summary, switch positions for the two process steps of the components involved may be defined as follows: in both process steps, i.e. in over inking (FIG. 2) and ink removal (FIG. 3), the blade-type ink fountain 10 is engaged with the screen roller 4, the ink applicator roller 5 is engaged with the screen roller 4, and the inking unit rollers 17 are engaged with the screen roller 4. In the over inking step (FIG. 2), the pivotable rear wall 12 is adjusted towards the doctor blade 11 to elevate the ink level 10 above the blade edge 15, and the bridge roller 9 is disengaged from the ink applicator roller 5. In the ink removal step (FIG. 3), the pivotable rear wall 12 is withdrawn from the doctor blade 11 to lower the ink level 16 below the blade edge 15 and the bridge roller 9 is engaged with the ink applicator roller 5.

The method including the two process steps allows ghost images created by the previous print job to be quickly and thoroughly removed from the roller surfaces, preventing the ghost images from creating spoiled prints when the next print job is started.

The invention claimed is:

1. A method for cleaning an anilox printing unit, the method comprising:

providing a forme cylinder, a blade-type ink fountain, a screen roller, an ink applicator roller and a dampening unit having a bridge roller;

in a first cleaning process step, feeding printing ink from the blade-type ink fountain to the screen roller while the ink applicator roller is in contact with the screen roller and out of contact with the bridge roller and with the forme cylinder; and in a second cleaning process step, immediately following the first cleaning process step without any intermediate printing operation, removing printing ink from the screen roller and returning the printing ink into the same blade-type ink fountain while the ink applicator roller is in contact with the screen roller and with the bridge roller.

2. The method according to claim 1, which further comprises providing the blade-type ink fountain with a doctor blade having a blade edge, and placing an ink level in the blade-type ink fountain above the blade edge in the first cleaning process step and below the blade edge in the second cleaning process step.

3. The method according to claim 2, which further comprises providing the blade-type ink fountain with a pivotable rear wall, and pivoting the pivotable rear wall towards the doctor blade in the first cleaning process step and away from the doctor blade in the second cleaning process step.

4. The method according to claim 1, which further comprises providing the dampening unit with a dampening solution applicator roller, and in the second cleaning process step, placing the bridge roller simultaneously in contact with the ink applicator roller and with the dampening solution applicator roller.

5. The method according to claim 1, which further comprises providing a distributor roller and at least two inking unit rollers constructed as rubber rollers, and placing the at least two inking unit rollers simultaneously in contact with the screen roller and with the distributor roller in the first cleaning process step and in the second cleaning process step.

* * * * *